US005336340A

United States Patent [19]

Cahn

[11] Patent Number: 5,336,340

[45] Date of Patent: Aug. 9, 1994

[54] NI-TI-AL ALLOYS

[75] Inventor: Robert W. Cahn, Cambridge, England

[73] Assignee: Rolls-Royce plc, London, England

[21] Appl. No.: 39,494

[22] Filed: Apr. 30, 1993

[30] Foreign Application Priority Data

Nov. 23, 1990 [GB] United Kingdom ..... 9025486.3

[51] Int. Cl.[5] ..... C22C 19/03

[52] U.S. Cl. ..... 148/409

[58] Field of Search ..... 148/409; 420/441

[56] References Cited

PUBLICATIONS

Thompson et al., "Structure and properties of the $Ni_3Al$ ($\gamma'$) Eutectic Alloys Produced by Unidirectional Solidification", American Society for Metals Transactions, Quarterly, vol. 62, No. 1, 1969, Metals Park, Ohio, US, pp. 140–154.

The Nickel-Rich Corner of the Ni-Al-Ti System, pp. 168–174, P. Willemin, M. Durano-Charre.

The High Intrinsic Creep Strength of Non-Stoichiometric $Ni_2AlTi$, pp. 594–595, R. S. Polvani, P. R. Strutt, and Wen-Shian Tzeng.

Scripta Metallurgica, vol. 17, pp. 209–214.

A Microstructural Study of $Ni_2AlTi$-Ni(Al,Ti)-$Ni_3$-(Al,Ti) three-phase Alloy, J. Mater. Res., vol. 6, No. 2, Feb. 1991, pp. 343–354.

Phase Equilibria in the Ni-Al-Ti System at 1173K, P. Nash and W. W. Liang, vol. 16A, Mar. 1985, pp. 319–322.

*Primary Examiner*—Deborah Yee

*Attorney, Agent, or Firm*—Cushman, Darby & Cushman

[57] ABSTRACT

Ni—Al—Ti alloys which are plastically deformable at room temperature and have good strength at high temperature include a structure of regions of a $\beta$ phase of ideal composition NiAl, a $\beta'$ phase of ideal composition $Ni_2TiAl$ and a $\gamma'$ phase of ideal composition $Ni_3Al$, the regions being epitaxially related to one another and preferably the $\beta$ phase or the $\gamma'$ phase is continuous.

11 Claims, 6 Drawing Sheets

NI-TI-AL ALLOYS

FIELD OF THE INVENTION

This invention is concerned with Ni—Al—Ti alloys containing more than 50 at % Ni. These alloys show an interesting combination of properties, creep resistance at high temperature and plastic deformability at ambient temperature, which make them candidates for use in high temperature structural components, such as rotor discs, rotor blades and stators of gas turbines. Three major phases may be present:

- A $\beta$ phase based on the ideal composition NiAl. This is an ordered body centred cubic phase.
- A $\beta'$ phase based on the ideal composition $Ni_2TiAl$. This is a Heusler phase and is another form of ordered body centred cubic phase.
- A $\gamma'$ phase based on the ideal composition $Ni_3Al$. This is an ordered face centred cubic phase.

BACKGROUND OF THE INVENTION

Research was carried out in 1976 on the high temperature creep behaviour of a series of alloys along the pseudo binary section NiAl—$Ni_2TiAl$ or $\beta+\beta'$. It turned out that the $\beta+\beta'$ alloys had very much higher creep resistance than either phase separately, though the $\beta'$ phase is more creep-resistant than $\beta$. (P. R. Strutt et al., *Met. Trans.* 1976, (7a) 23, 31). However, all $\beta/\beta'$ alloys are known to be highly brittle, especially at low temperatures, so that their use in demanding environments such as turbines cannot be contemplated. This invention arises from the idea that the $Ni_3Al$ $\gamma'$ phase might impart room temperature ductility without destroying high temperature creep resistance

SUMMARY OF THE INVENTION

In one aspect the invention provides a Ni—Al—Ti alloy comprising a structure of regions of a $\beta$ phase and a $\beta'$ phase and a $\gamma'$ phase, the $\beta$ regions and the $\beta'$ regions and at least a part of the $\gamma'$ regions being epitaxially related to one another, wherein the $\beta$ phase is based on the ideal composition NiAl, the $\beta'$ is a Heusler phase based on ideal composition $Ni_2TiAl$, and the $\gamma'$ is a phase based on the ideal composition $Ni_3Al$. In one preferred aspect, the $\beta'$ regions and the $\gamma'$ regions are distributed in a $\beta$ matrix. In another preferred aspect, the $\beta$ regions and the $\beta'$ regions are distributed in a $\gamma'$ matrix.

A proportion of the $\gamma'$ phase may have been formed during initial solidification (depending on alloy composition) arbitrarily oriented with respect to the $\beta$ matrix, and may have survived subsequent heat treatment. But a proportion, usually a major proportion and often all, of the $\gamma'$ phase is preferably present in the form of plates or blocks epitaxially related to both the $\beta$ and $\beta'$ phases. The epitaxial relation means that the crystallographic orientations of the various phases are precisely related to each other in a defined way. In particular, the $\beta$ and $\beta'$ phases are in parallel, i.e. identical orientations, while each preferably is related to the $\gamma'$ phase in terms of a Nishiyama-Wassermann relationship, although a different epitaxial orientation relationship is possible.

Attention is directed to FIG. 1 of the accompanying drawings which is a ternary phase diagram of the nickel-rich corner of the Ni—Al—Ti diagram. The ideal compositions of the $\beta$ and $\beta'$ and $\gamma'$ phases are marked as P, Q and R. In the presence of the other two phases, the positions of these points are modified by mutual solubilities and other factors. The inventors current estimates for these modified positions, based on experiment, are shown as P', Q' and R'. Thus, the three phases are found together in equilibrium at alloy compositions within the triangle P' Q' R'.

It is found that the $\beta/\beta'$ combination generates high creep resistance, while the dispersion of coherent or semi coherent epitaxially oriented $\gamma'$ plates or blocks contributes to the plastic deformability even at room temperature. Plastic deformability seems to be achieved by the introduction of the $\gamma'$ phase primarily when the matrix is $\beta$, i.e. when the alloy contains a substantial proportion of the $\beta$ phase. If the alloy has a $\beta'$ matrix, i.e. is rich in the $\beta'$ phase, it usually remains brittle or very little plastic deformability, even in the presence of $\gamma'$ precipitates. On the other hand, if the matrix is $\gamma'$, then the material is certainly plastically deformable but is also somewhat weaker at ambient temperature than if the matrix is $\beta$ or $\beta'$. The upshot of these considerations is that the alloy has an excellent combination of strength, high temperature creep resistance and room temperature ductility if the microstructure consists of a matrix of $\beta$ phase with dispersions of $\beta'$ particles and $\gamma'$ plates (or blocks). For this reason, a preferred range of ternary compositions is near the P' R' edge of the three phase triangle, nearer the P' corner than the R' corner, and nearer the P' corner than the Q' corner.

In another aspect, the invention provides a Ni—Al—Ti alloy having a composition falling within the shaded area Z of the three phase diagram of FIG. 1*a*.

Alloys having a $\gamma'$ matrix with $\beta$ regions and $\beta'$ regions distributed in it constitute another preferred aspect of the invention. Such alloys are plastically deformable at all temperatures, and their creep strength may rise with increasing temperature, so as to be at least comparable with the $\beta$ matrix alloys at 600°-800° C. Alloys having a $\beta'$ matrix have high strength and may also be of interest in some instances.

The above alloy compositions are based on the Ni+Al+Ti content of the alloy. Although not preferred, it is envisaged that the alloy may also contain up to 10 at % in total of other components. Fe may be included to improve plastic deformability. Cr may be included to improve strength. Mn may also be included, as may many other metals which do not significantly spoil the properties. The proportion of each of these added components, and of all taken together, should preferably be in the range 0.1 to 10 at %. Boron may also be included, preferably at a concentration of 0.1 to 0.5 at %, to improve ductility. Carbon may be included, preferably at concentrations up to 1.5 at %. Other deliberate additions are preferably avoided, but adventitious impurities may be present to the extent normally permissible in alloys intended for high temperature structural duties such as gas turbine blades or discs.

The desired epitaxial relationship of the three phases may be obtained by homogenising the cast alloy, followed by heat treatment at a somewhat lower temperature. Homogenisation may be effected under standard conditions to reduce segregation, e.g. 1000°-1200° C. for 6 to 24 hours. The subsequent heat treatment is preferably effected at a temperature of 700°-1100° C., particularly 800°-1000° C. for a period of 6 hours to 14 days, particularly 1-7 days. As is well known, if the temperature is too low, the alloy takes an inconveniently long time to equilibrate; if the temperature is too high, the phases may become inconveniently coarse.

Alloys according to this invention in which the phases are in epitaxial relation, typically show ambient temperature compressive strain properties of at least 3–4% and often greater than 10%, while retaining the high temperature creep resistance properties that are typical of alloys of this kind.

BRIEF DESCRIPTION OF THE DRAWINGS

Reference is directed to the accompanying drawings, in which:

FIG. 1 is, as noted above, a ternary phase diagram of the nickel-rich corner of the Ni—Al—Ti diagram. The figure is in three parts, 1*a*, 1*b* and 1*c;*

DETAILED DESCRIPTION OF THE INVENTION

The following examples illustrate the invention.

EXAMPLE 1

Figure 1A:
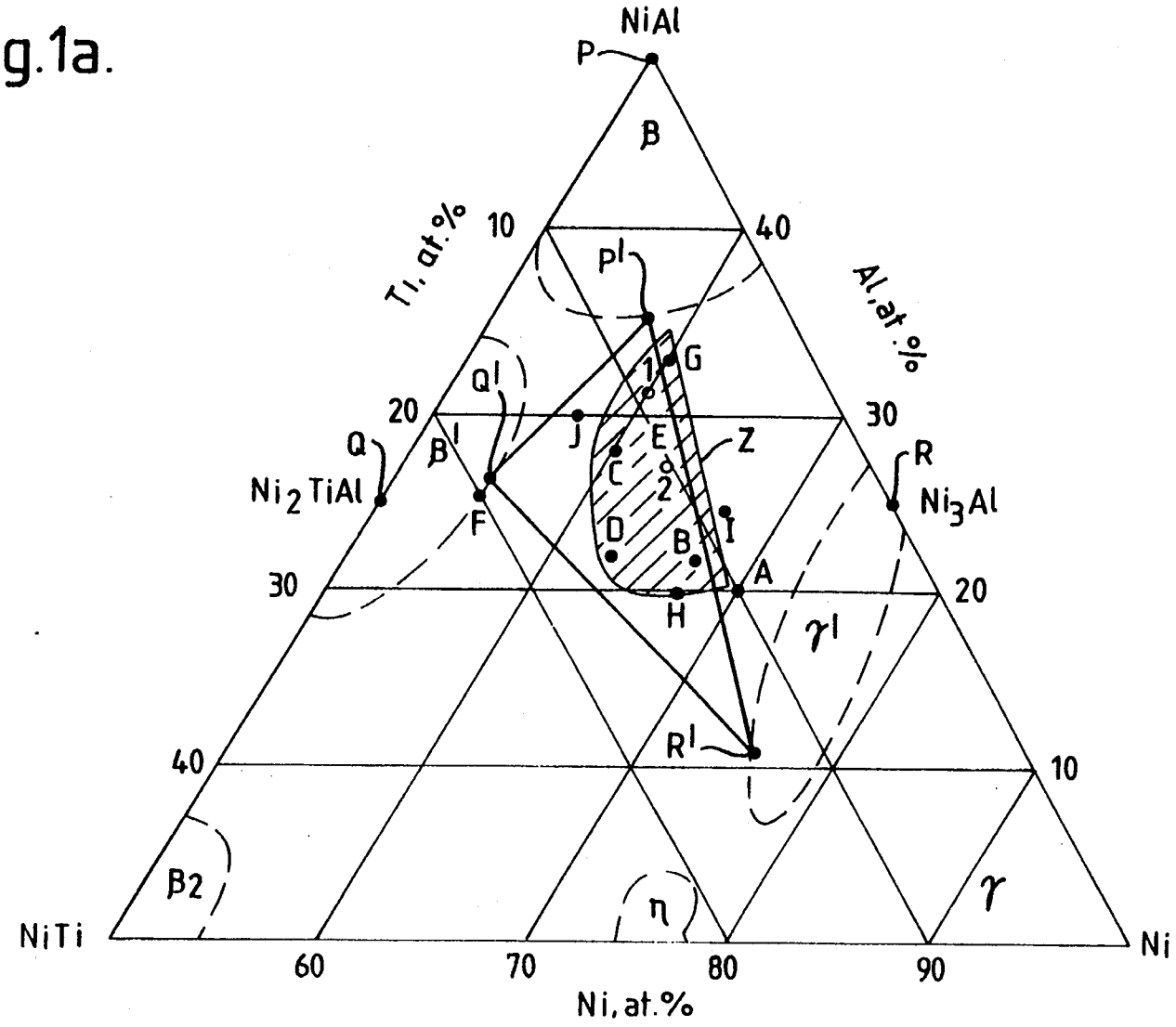
FIG. 1*a* shows, as has been discussed above, the three phase triangle P′ Q′ R′ and the preferred composition region Z.
Figure 1B:
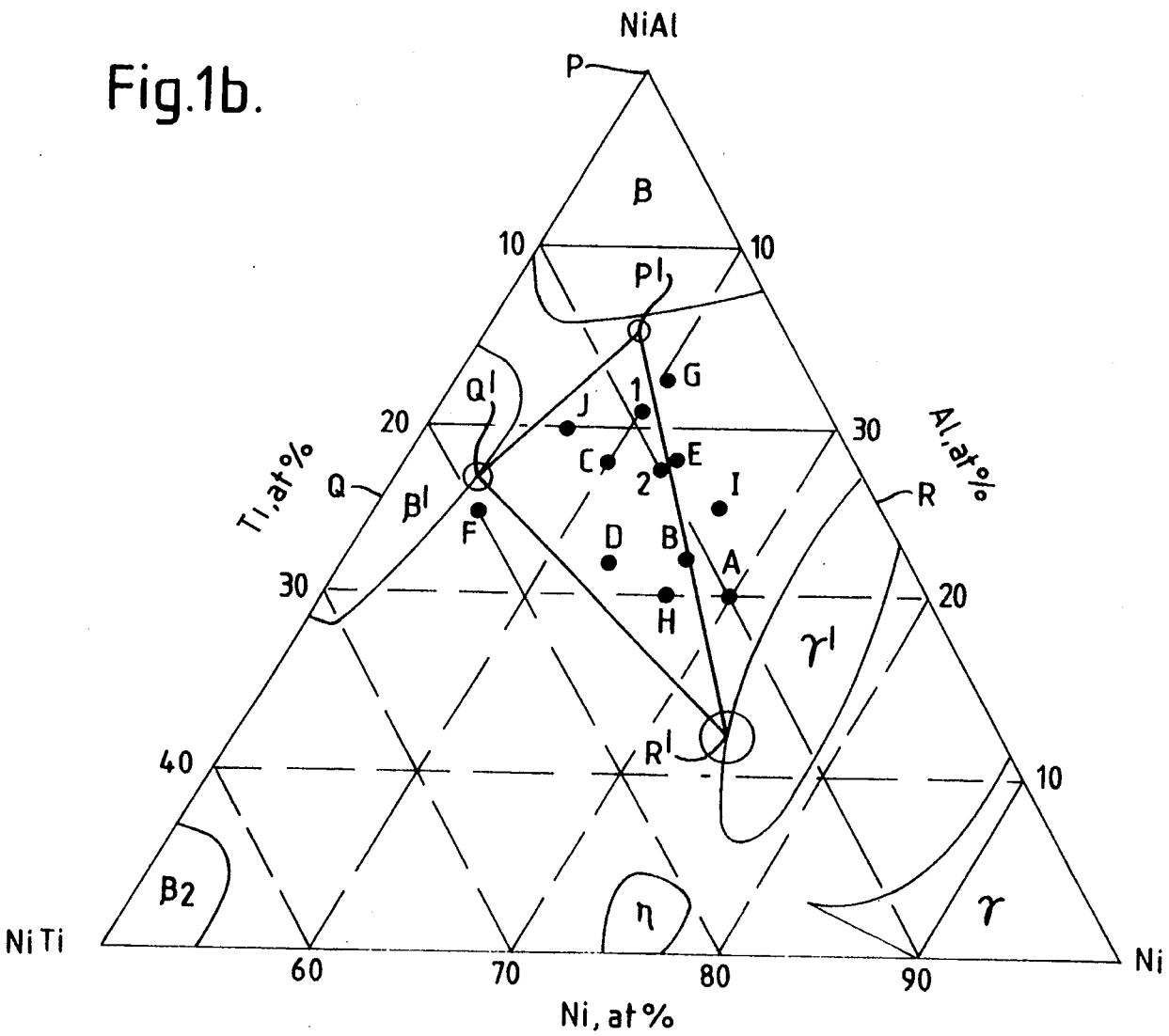
FIG. 1*b* shows the same three phase triangle, but the points P′, Q′ and R′ have been enlarged to small circles to indicate a small degree of uncertainty about the precise compositions of those points.
Figure 1C:
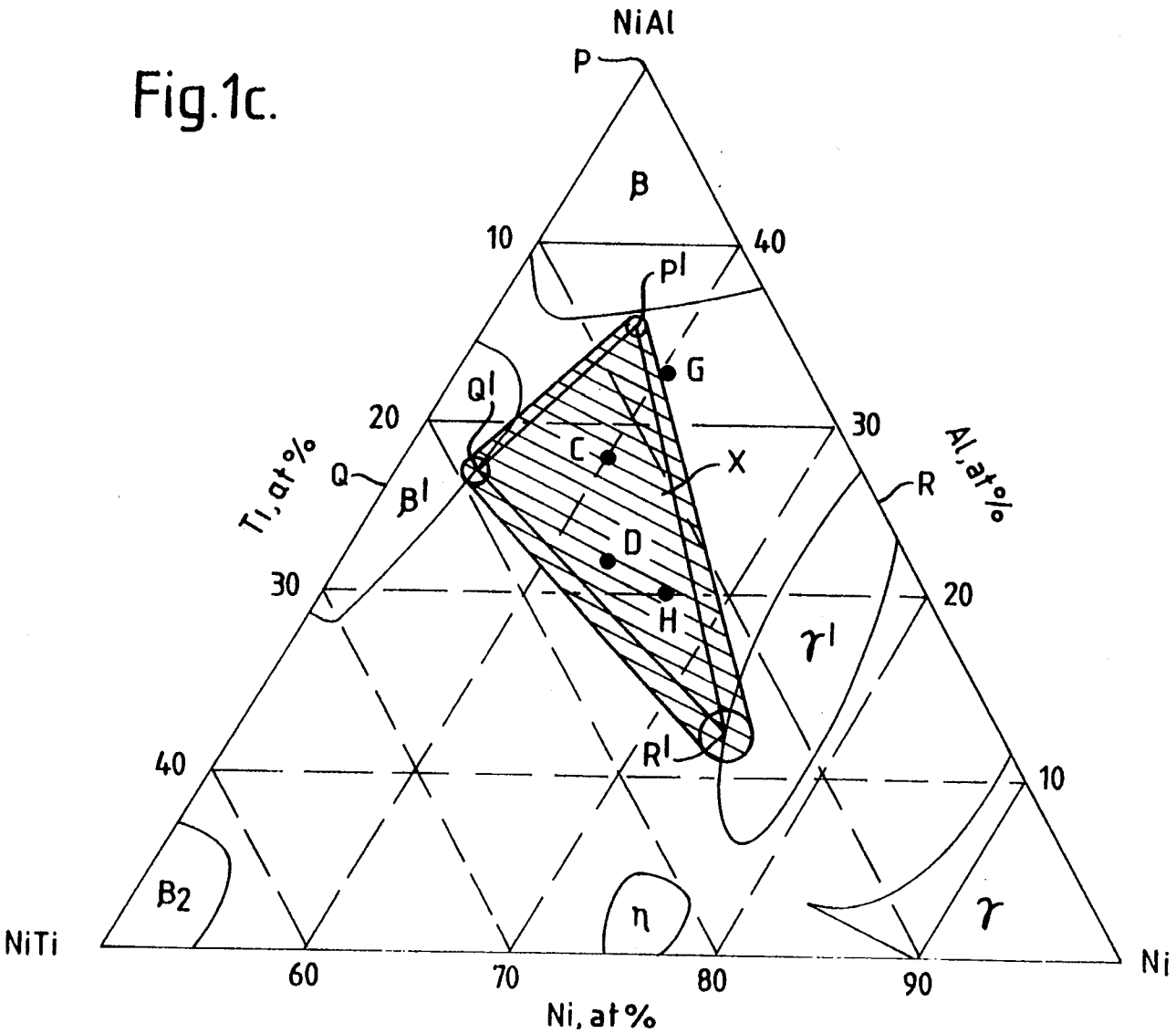
FIG. 1*c* shows the shaded region X within which fail all alloys according to the invention.

The 900° C. isothermal section of the $\beta'$-$\beta$-$\gamma'$ three-phase region has been determined using EDAX analysis of thin-foil specimens in TEM. (Specimen preparation is described in Example 2). For absorption correction, the foil thickness was measured using the convergent beam electron diffraction method (Kelly's method). The correction was made in an iteration sequence, starting from the stoichiometric density of the compounds concerned. The shape of the three-phase region in the Ni—Al—Ti ternary system was determined using equilibrated alloys C and D (for nominal composition, see Table 4). The data are given in Table 1, each being an average of five. These data form the basis of the triangle P′ Q′ R′ in FIG. 1.

The effect of 5 at % Cr and Fe on the phase boundary of the three-phase region has also been evaluated, and the analyses, each on two alloys, are listed in Tables 2 and 3. The addition of 5 at % Cr invariably resulted in the precipitation of $\alpha$ phase (from the $\beta$ or $\beta'$ phase), which is almost pure Cr. These $\alpha$ phase precipitates are coherent with $\beta$ or $\beta'$ matrix. (The lattice constants of the stoichiometric $\beta$, $\beta'$ phases and pure Cr are, respectively, 0.28864 nm, 0.29215 nm and 0.288 nm). Fe does not cause any new phase, and it seems to dissolve more into the $\beta$ or $\beta'$ phase, and less to the $\gamma'$ phase. The addition of both Cr and Fe (5 at %) results in a slight disordering of the $\gamma'$ phase.

EXAMPLE 2

Alloys of various compositions shown in Table 4 were cast, and were subjected to heat treatment as shown in Tables 5 to 7. The compositions of alloys A to J are shown on FIG. 1, as are the composition of two further alloys 1 and 2 referred to in Table 8. The following alloys were prepared by way of comparison:

Udimet 720 (U720) of composition (wt %) C 0.03, Al 2.50, B 0.035, Co 14.75, Cr 18.00, Mo 3.00, Ti 5.00, W 1.25, Zr 0.035, balance Ni (as described in British Patent Specification 1565606).

A $\beta/\beta'$ alloy of composition (at %) Ni 50.5, Al 39.2, Ti 10.3. This was used as-cast or as-extruded.

Alloys A to J were cast in a laboratory scale arc-furnace using a water-cooled copper hearth and were remelted several times to ensure homogeneity. Alloys 1 and 2 were made on a larger scale by powder metallurgy. The powder was made by argon atomisation, sheathed and hot isostatically pressed. Heat treatment of all alloys was typically 55 h at 1100° C. followed by 72 h at 900° C., unless otherwise indicated. Compression specimens were formed by machining the heat-treated alloys.

Specimens with dimensions of $3.2\times3.2\times8.0$ mm were tested at a compression strain rate of $2.5\times10^{-4}$ $s^{-1}$. The results are set out in Table 5.

The $\beta/\beta'$ alloy was brittle. The alloys designated F and J in Table 4 were similarly brittle and could not be subjected to compression testing. Usually cracks were found in the as-cast ingots of these compositions.

Some of the alloy microstructure were examined:

B was mainly $\beta$ phase dispersed in a $\gamma'$ matrix.

C contained $\beta'$ and $\gamma'$ dispersed in a $\beta$ matrix.

D comprised $\beta$ plus $\gamma'$ dispersed in a $\beta'$ matrix.

E was $\gamma'$ phase dispersed in a $\beta$ matrix.

G was $\gamma'$ phase dispersed in a $\beta$ matrix.

H comprises $\beta$ and $\beta'$ phases in a $\gamma'$ matrix.

Temperatures quoted hereafter are believed accurate to within plus or minus 25° C. approximately. Equipment limitations did not permit greater accuracy.

Table 5 shows compression testing results on some of the alloys. In cases where indicated, tests were stopped by the investigator after the indicated strain and without fracturing the specimens.

Table 6 represents data obtained on slightly strained samples which were made for the specific purpose of electron microscopy.

Table 7 represents additional high-temperature data.

Figure 2:
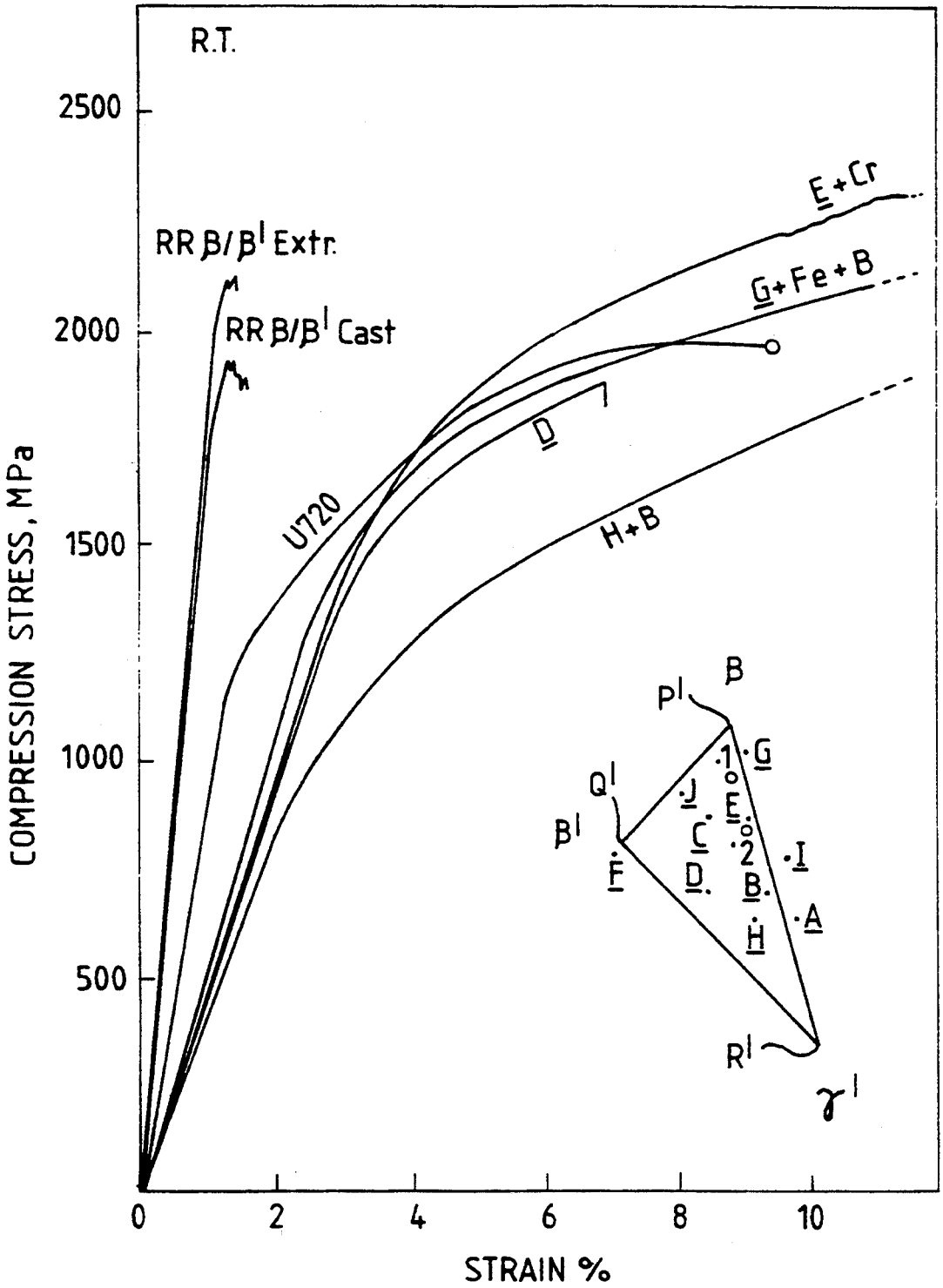
FIG. 2 is a graph of compression stress against strain for various alloys at room temperature.
Figure 3:
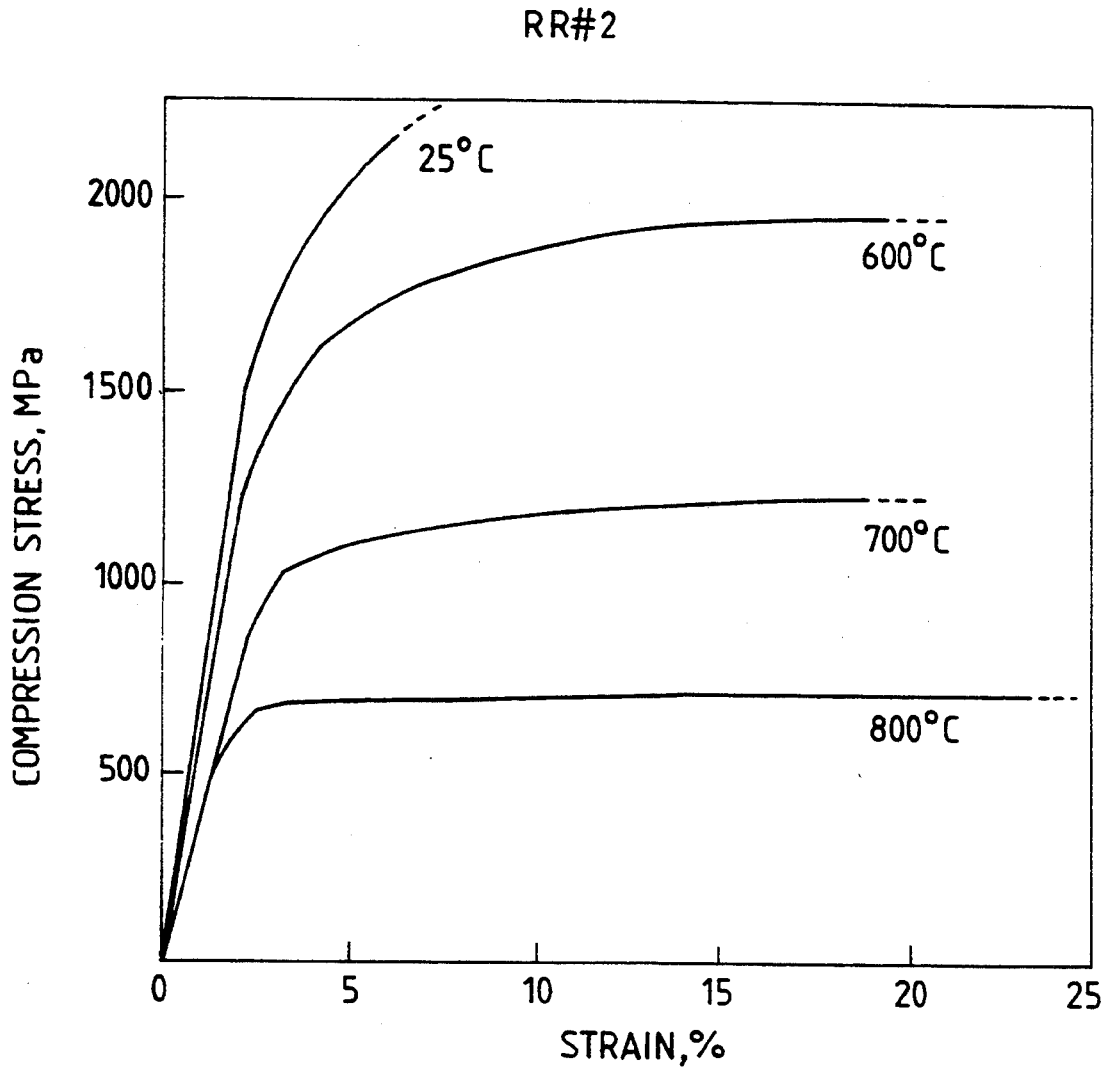
FIG. 3 is a graph of compression stress against strain for the alloy RR#2 at various temperatures.
Figure 4:
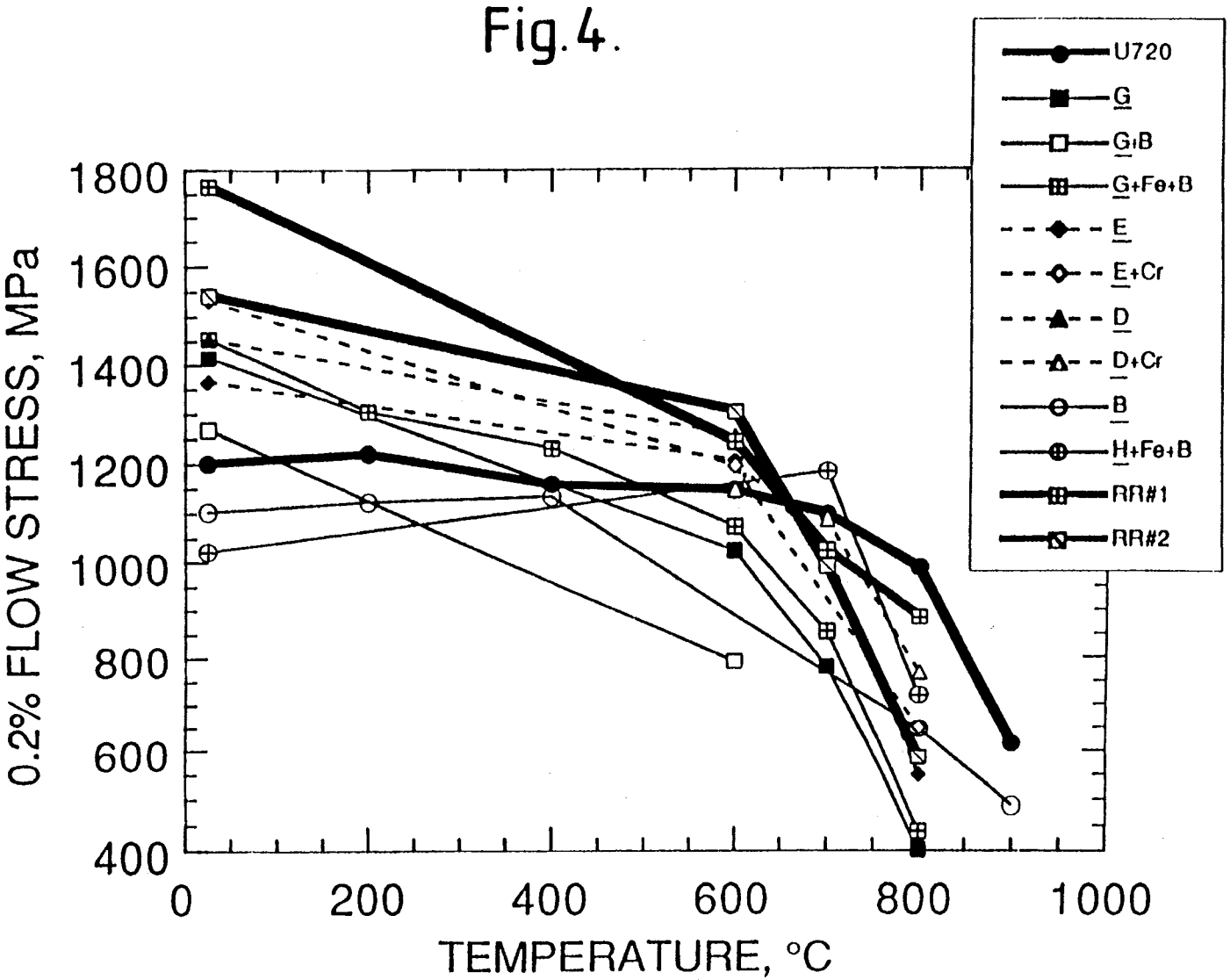
FIG. 4 is a graph of flow stress at 0.2% strain against temperature for various alloys.

Typical stress-strain curves obtained with the tests at room temperature are shown in FIGS. 2. Stress-strain curves obtained on alloy 2 at various elevated temperatures are shown in FIG. 3. The variation of 0 .2% flow stress with temperature up to 900° C. are plotted in FIG. 4. The 0.2% yield strength of the best three-phase intermetallics is superior to that of the superalloy U720 up to 650° C. The higher work-hardening rate of U720 perhaps indicates better high-temperature creep resistance than the three-phase alloys of this invention. This is reasonable, considering that only a few elements are involved in these alloys and their compositions have not been optimised. The estimated density values of some alloys and the compounds are listed in Table 8, and the increase in density-compensated strength of the three-phase alloy up to about 700° C. is evident.

Fe and B additions make no significant difference to strength, but Cr does offer the possibility of strengthening (e.g. compare E and E+Cr in Table 5).

TABLE 1

| 900° C. Phase Equilibrium Data (at %) | | | |
|---|---|---|---|
| PHASE | Ni | Al | Ti |
| $\beta'$ | 54.8 | 26.2 | 19.0 |
| $\beta$ | 57.8 | 35.3 | 6.9 |

TABLE 1-continued

| 900° C. Phase Equilibrium Data (at %) | | | |
|---|---|---|---|
| PHASE | Ni | Al | Ti |
| $\gamma'$ | 76.0 | 10.6 | 13.4 |

TABLE 2

| PHASE | Ni | Al | Ti | Cr |
|---|---|---|---|---|
| | a) $(Ni_{63}Al_{22}Ti_{15})_{95}Cr_5$ | | | |
| $\beta'$ | 51.8 | 29.7 | 15.5 | 3.0 |
| $\beta$ | 54.3 | 36.3 | 7.0 | 2.4 |
| $\gamma'$ | 76.4 | 7.1 | 13.9 | 2.6 |
| $\alpha$ | 13.0 | 3.0 | 2.7 | 81.3 |
| | b) $(Ni_{63}Al_{28}Ti_9)_{95}Cr_5$ | | | |
| $\beta'$ | 54.9 | 26.7 | 15.3 | 3.1 |
| $\beta$ | 57.1 | 32.8 | 7.0 | 3.1 |
| $\gamma'$ | 73.9 | 12.5 | 12.4 | 1.2 |
| $\alpha$ | 9.1 | 2.5 | 1.2 | 87.2 |

TABLE 3

| PHASE | Ni | Al | Ti | Fe |
|---|---|---|---|---|
| | a) $(Ni_{60}Al_{28}Ti_{12})_{95}Fe_5$ | | | |
| $\beta'$ | 54.2 | 25.0 | 15.0 | 5.8 |
| $\beta$ | 55.9 | 30.4 | 7.5 | 6.2 |
| $\gamma'$ | 72.2 | 10.4 | 13.0 | 3.9 |
| | b) $(Ni_{67}Al_{20}Ti_{13})_{95}Fe_5$ | | | |
| $\beta'$ | 52.6 | 25.8 | 15.3 | 6.3 |
| $\beta$ | 57.9 | 26.7 | 8.7 | 6.7 |
| $\gamma'$ | 71.7 | 10.9 | 12.5 | 4.9 |

TABLE 4

COMPOSITION OF SOME ALLOYS IN THE $\beta'$-$\beta$-$\gamma'$ THREE-PHASE REGION

| CODE | COMPOSITION, at % |
|---|---|
| A | $Ni_{70}Al_{20}Ti_{10}$ |
| B | $Ni_{67}Al_{22}Ti_{11}$ |
| C | $Ni_{60}Al_{28}Ti_{12}$ |
| C + B | $Ni_{60}Al_{28}Ti_{12}$ + 0.1 wt % B |
| C + Fe + B | $(Ni_{60}Al_{28}Ti_{12})_{95}Fe_5$ + 0.1 wt % B |
| D | $Ni_{63}Al_{22}Ti_{15}$ |
| D + Cr | $(Ni_{63}Al_{22}Ti_{15})_{95}Cr_5$ |
| E | $Ni_{63}AL_{28}Ti_9$ |
| E + Cr | $(Ni_{63}Al_{28}Ti_9)_{95}Cr_5$ |
| F | $Ni_{55}Al_{25}Ti_{20}$ |
| F + B | $Ni_{55}Al_{25}Ti_{20}$ + 0.1 wt % B |
| F + Cr | $(Ni_{55}Al_{25}Ti_{20})_{95}Cr_5$ |
| G | $Ni_{60}Al_{33}Ti_7$ |
| G + B | $Ni_{60}Al_{33}Ti_7$ |
| G + Fe + B | $(Ni_{60}Al_{33}Ti_7)_{95}Fe_5$ + 0.1 wt % B |
| G + Cr | $(Ni_{60}Al_{33}Ti_7)_{95}Cr_5$ |
| H + B | $Ni_{67}Al_{20}Ti_{13}$ + 0.1 wt % B |
| H + Fe + B | $(Ni_{67}Al_{20}Ti_{13})_{95}Fe_5$ + 0.1 wt % B |
| I + B | $Ni_{67}Al_{25}Ti_8$ + 0.1 wt % B |
| J | $Ni_{57}Al_{30}Ti_{13}$ |

TABLE 5

COMPRESSION TESTING RESULTS ON SOME OF THE ALLOYS

| Alloy | Heat Treatment (Hours) 1100° C./900° C. | Testing Temp. (°C.) | 0.2% Yield Stress (MPa) | Plastic Strain (%) |
|---|---|---|---|---|
| C + B | 55/72 | R.T. | 1357 | 9.3 |
| C + Fe + B | 55/72 | 600 | 1220 | 19.3 |
| D | 3/115 | R.T. | 1445 | 3.6 |
| D | 3/115 | 600 | 1257 | 21 |
| D + Cr | 55/72 | R.T. | *** | *** |
| D + Cr | 55/72 | 600 | 1147 | 20.5 |
| E + Cr | 55/72 | R.T. | 1533 | 10.4 |
| E + Cr | 55/72 | 600 | 1196 | 24 |
| G | 55/72 | R.T. | 1416 | 9.6 |
| G | 55/72 | 600 | 915 | 17.3 |

TABLE 5-continued

COMPRESSION TESTING RESULTS ON SOME OF THE ALLOYS

| Alloy | Heat Treatment (Hours) 1100° C./900° C. | Testing Temp. (°C.) | 0.2% Yield Stress (MPa) | Plastic Strain (%) |
|---|---|---|---|---|
| G + B | 55/72 | R.T. | 1270 | 13.3 |
| G + B | 55/72 | 600 | 793 | 23.4 |
| G + Fe + B | 55/72 | 600 | 879 | 24.8 |
| G + Fe + B | 20/53 | R.T. | 1455 | 10.3 |
| G + Fe + B | 55/72 | 200 | 1306 | 10 |
| G + Fe + B | 55/72 | 600 | 1074 | 19.4 |
| G + Cr | 55/72 | R.T. | *** | *** |
| G + Cr | 55/72 | 600 | 927 | 22.3 |
| H + B | 55/72 | R.T. | 1025 | 12.9 |
| H + Fe + B | 55/72 | R.T. | 1023 | 6.1 |
| U720 | | 600 | 1172 | 9.1 |
| $\beta/\beta'$ | as-cast | R.T. | 1855 | ~0 |
| $\beta/\beta'$ | as-cast | 600 | 1416 | 2.3 |
| $\beta/\beta'$ | as-extruded | R.T. | 2060 | ~0 |
| $\beta/\beta'$ | as-extruded | 600 | 2026 | 1 |
| B | * | R.T. | 1103 | 11 |
| B | * | 600 | 1135 | 13.8 |
| B | * | 400 | 1123 | 12.7 |
| D + Cr | 55/72 | 700 | 1086 | 12.9** |
| E | * | R.T. | 1037 | 6.1 |
| E | * | 400 | 1028 | 11.7 |
| E | * | 600 | 1208 | 12.9 |
| E | * | 700 | 1025 | 20.9** |
| G | 55/72 | 700 | 928 | 12.1** |
| G + Fe + B | 55/72 | 700 | 854 | 13.3** |
| H + Fe + B | 55/72 | 700 | 1184 | 17.1** |
| U720 | R.T | 1162 | 9.6** | |
| U720 | 700 | 1098 | 17.6** | |
| 1 | 48/96 | R.T. | 1767 | 9.4 |
| 1 | 48/96 | 600 | 1245 | 14.3** |
| 1 | 48/96 | 700 | 1025 | 12.5 |
| 2 | 48/96 | R.T. | 1543 | 11 |
| 2 | 48/96 | 600 | 1013 | 20.6** |

***Specimens fractured before yielding point.
*Heat Treatment 4 hrs at 1050° C./90 hrs at 900° C.
**Tests stopped by investigator.

TABLE 6

Slightly Strained Samples prepared for Electron Microscopy, including Sample Geometry

| Alloy | Specimen Dimension (mm) | Testing Temp. (°C.) | 0.2% Yield Stress (MPa) | Plastic Strain (%) |
|---|---|---|---|---|
| 1 | 4.5 × 4.5 × 9.0 | R.T. | 1717 | 2.2 |
| 2 | 4.0 × 4.0 × 8.0 | R.T. | 1417 | 2.5 |
| B | 4.0 × 4.0 × 8.0 | R.T. | 1047 | 2.4 |
| E | 4.4 × 4.4 × 8.8 | R.T. | 1330 | 3.8 |
| G | 3.2 × 3.2 × 8.0 | R.T. | 1435 | 1.8 |
| G + Fe + B | 3.2 × 3.2 × 8.0 | R.T. | 1396 | 2.1 |

TABLE 7

| Alloy | Heat Treatment (Hours) 1100° C./900° C. | Testing Temp. (°C.) | 0.2% Yield Stress (MPa) | Plastic Strain (%)** |
|---|---|---|---|---|
| B | * | 800 | 647 | 20 |
| B | * | 900 | 488 | 15 |
| C + B | 55/72 | 800 | 683 | 25 |
| C + Fe + B | 55/72 | 800 | 647 | 20 |
| D + Cr | 55/72 | 800 | 769 | 14 |
| E | * | 800 | 549 | 20 |
| E + Cr | 55/72 | 800 | 650 | 20 |
| G | 55/72 | 600 | 1025 | 15 |
| G | 55/72 | 700 | 781 | 10 |
| G | 800 | 403 | 25 | |
| G + Fe + B | 55/72 | 800 | 439 | 12 |
| H + B | 55/72 | 800 | 688 | 15 |
| H + Fe + B | 55/72 | 800 | 720 | 20 |
| U720 | | 600 | 1148 | 10 |
| U720 | | 800 | 988 | 15 |
| U720 | | 900 | 615 | 15 |

TABLE 7-continued

| Alloy | Heat Treatment (Hours) 1100° C./900° C. | Testing Temp. (°C.) | 0.2% Yield Stress (MPa) | Plastic Strain (%)** |
|---|---|---|---|---|
| 1 | 48/96 | 800 | 886 | 25 |
| 2 | 48/96 | 600 | 1306 | 15 |
| 2' | 48/96 | 700 | 990 | 15 |
| 2 | 48/96 | 800 | 586 | 25 |

*Heat Treatment 4 hrs at 1050° C./90 hrs at 900° C.
**Tests stopped by investigator after the indicated strain without fracturing specimens.
'Specimen size 3.0 × 3.2 × 8.0 mm

TABLE 8

ESTIMATED DENSITY OF SOME ALLOYS AND COMPOUNDS

| ALLOY | COMPOSITION, at % | DENSITY, $gcm^{-3}$ |
|---|---|---|
| U720 | ** | 8.04 |
| $\beta/\beta'$ | $Ni_{50.5}Al_{39.2}Ti_{10.3}$ | 6.02 |
| 1 | $Ni_{60}Al_{31}Ti_{9}$ | 6.59 |
| 2 | $Ni_{63}Al_{27}Ti_{10}$ | 6.90 |
| NiAl | | 5.80 |
| $Ni_2AlTi$ | | 6.26 |
| $Ni_3Al$ | | 7.36 |

**(in at %) C 0.14, Al 5.2, B 0.18, Co 14.05, Cr 19.43, Mo 1.76, Ti 5.86, W 0.38, Zr 0.0215, Ni 52.98.

I claim:

1. A Ni—Al—Ti alloy comprising a structure of $\beta'$ regions and $\gamma'$ regions distributed in a $\beta$ matrix, the $\beta'$ regions and at least a part of the $\gamma'$ regions being epitaxially related to the $\beta$ matrix, wherein the $\beta$ phase is based on the ideal composition NiAl, the $\beta'$ is a Heusler phase based on ideal composition $Ni_2TiAl$, and the $\gamma'$ is a phase based on the ideal composition $Ni_3Al$.

2. An alloy as claimed in claim 1, wherein the $\gamma'$ phase is in the form of plates or blocks.

3. An alloy as claimed in any one of claims 1 to 2 having a compression strain at room temperature of at least 3%.

4. A Ni—Al—Ti alloy comprising a structure of regions of a $\beta$ phase and a $\beta'$ phase and a $\gamma'$ phase, the $\beta$ regions and the $\beta'$ regions and at least part of the $\gamma'$ regions being epitaxially related to one another, wherein the $\beta$ phase is based on the ideal composition NiAl, the $\beta'$ is a Heusler phase based on ideal composition $Ni_2TiAl$, and the $\gamma'$ is a phase based on the ideal composition $Ni_3Al$.

5. A Ni—Al—Ti alloy comprising a structure of $\beta'$ regions and $\gamma'$ regions distributed in a $\beta$ matrix, the $\beta'$ regions and at least a part of the $\gamma'$ regions being epitaxially related to the $\beta$ matrix, wherein the $\beta$ phase is based on the ideal composition NiAl, the $\beta'$ is a Heusler phase based on the ideal composition $Ni_2TiAl$, and the $\gamma'$ is a phase based on the ideal composition $Ni_3Al$, wherein at least one of Cr, Fe and Mn is present, the combined concentration of all three being 0.1–10 at %.

6. A Ni—Al—Ti alloy comprising a structure of $\beta'$ regions and $\gamma'$ regions distributed in a $\beta$ matrix, the $\beta'$ regions and at least a part of the $\gamma'$ regions being epitaxially related to the $\beta$ matrix, wherein the $\beta$ phase is based on the ideal composition NiAl, the $\beta'$ is a Heusler phase based on the ideal composition $Ni_2TiAl$, and the $\gamma'$ is a phase based on the ideal composition $Ni_3Al$, wherein B is present at a concentration of 0.01–0.5 at %.

7. A Ni—Al—Ti alloy having a composition falling within the shaded area Z of the 3-phase diagram of FIG. 1*a* and the shaded area X of FIG. 1*c* and comprising a structure of $\beta$ regions and $\beta'$ regions distributed in a $\gamma'$ matrix.

8. A Ni—Al—Ti alloy having a composition falling within the shaded area Z of the three-phase diagram of FIG. 1 wherein the three phases of the alloy are epitaxially related.

9. A Ni—Al—Ti alloy having a composition falling within the shaded area X of FIG. 1*c* wherein the three phases of the alloy are epitaxially related.

10. A Ni—Al—Ti alloy having a composition falling within the shaded area Z of the three-phase diagram of FIG. 1*a* and falling within the shaded are X of FIG. 1*c*.

11. An alloy as claimed in claim 7 comprising a structure of $\beta$ regions and $\beta'$ regions distributed in a $\gamma'$ matrix.

* * * * *